US008676071B2

(12) United States Patent
Tabb et al.

(10) Patent No.: US 8,676,071 B2
(45) Date of Patent: Mar. 18, 2014

(54) INTERDOCUMENT PHOTORECEPTOR SIGNAL SENSING AND FEEDBACK CONTROL OF PAPER EDGE GHOSTING

(75) Inventors: Charles H. Tabb, Penfield, NY (US); Eliud Robles-Flores, Webster, NY (US); Moritz P. Wagner, Rochester, NY (US); Jyothsna Ram, Pittsford, NY (US); Michael J. Turan, Walworth, NY (US); Robert E. Rosdahl, Jr., Ontario, NY (US)

(73) Assignee: Xerox Corporation, Norwalk, CT (US)

( * ) Notice: Subject to any disclaimer, the term of this patent is extended or adjusted under 35 U.S.C. 154(b) by 151 days.

(21) Appl. No.: 13/008,494

(22) Filed: Jan. 18, 2011

(65) Prior Publication Data

US 2012/0183316 A1 Jul. 19, 2012

(51) Int. Cl.
*G03G 15/02* (2006.01)

(52) U.S. Cl.
USPC ..... 399/50; 399/66

(58) Field of Classification Search
USPC ..... 399/50
See application file for complete search history.

(56) References Cited

U.S. PATENT DOCUMENTS 5,448,277 A * 9/1995 Long ..... 347/129
6,284,424 B1 * 9/2001 Iimura et al. ..... 430/110.4
7,257,357 B2 8/2007 Lundy et al.
7,315,719 B2 1/2008 Wagner et al.
7,537,873 B2 5/2009 Graham et al.
7,706,722 B2 4/2010 Hildebrand et al.
7,787,812 B2 8/2010 Wayman
7,826,770 B2 11/2010 Wing et al.
2003/0228177 A1 12/2003 Hirsch
2006/0114490 A1 6/2006 Rolleston
2006/0263118 A1 * 11/2006 Lundy et al. ..... 399/296
2007/0147864 A1 6/2007 Markovics et al.
2007/0242967 A1 * 10/2007 Hano et al. ..... 399/49
2008/0298858 A1 12/2008 Schnepf et al.
2009/0246666 A1 10/2009 Wu et al.
2009/0325091 A1 12/2009 Wu et al.
2010/0068637 A1 3/2010 Wu
2010/0068638 A1 3/2010 Wu
2010/0221648 A1 9/2010 Wu et al.
2010/0279216 A1 11/2010 Wu
2011/0014563 A1 1/2011 Kim et al.

* cited by examiner

*Primary Examiner* — David Gray
*Assistant Examiner* — Thomas Giampaolo, II
(74) *Attorney, Agent, or Firm* — Fay Sharpe LLP

(57) ABSTRACT

Apparatus and method for minimizing ghosting defects and process control instabilities for a printing system are disclosed. According to an exemplary embodiment, a controller retrieves uniformity measurements of an interdocument zone (IDZ) and sheet zone (SZ). In response to the uniformity measurements, a transfer current IDZ level is controlled to minimize differences in subsequent charging, photodischarge and/or development associated with the IDZ and SZ.

7 Claims, 5 Drawing Sheets

POST STRIPPING IDZ VS SZ
PHOTORECEPTOR VOLTAGE PROFILE

INTERDOCUMENT PHOTORECEPTOR SIGNAL SENSING AND FEEDBACK CONTROL OF PAPER EDGE GHOSTING

BACKGROUND

This disclosure relates generally to corona transfer systems for ionographic or electrophotographic imaging and printing apparatuses and machines, and more particularly is directed to a method to improve the appearance of a ghosting print defect in such systems.

In xerographic direct transfer to paper systems, there are frequently ghosting issues associated with differential positive charge treatment due to positive charging transfer corona, for example. Paper at a sheet zone (SZ) or a document zone (DZ) partially blocks a photoreceptor of the system from the positive corona, while in an interdocument zone (IDZ) the photoreceptor is exposed to the complete positive current output of the transfer device. Current organic photoreceptors are designed to photo-discharge a single polarity of charge. In the systems under discussion, negative charging photoreceptors are combined with negative charging toner and discharge area development and positive transfer. This disclosure is not limited to any one type of polarity of charge. In typical systems, negative non-uniform residual charge can be minimized by photo discharge in an erase step post-transfer. However positive residual charge is not erased. These positive charges can only be discharged by a later negative charge step. If the positive charge is non-uniform and the negative charge step is not robust enough, then the non-uniform post-transfer charge may get trapped in one of the photoreceptor layers, and can result in non-uniform charge and development voltages and non-uniform image density in later photoreceptor cycles.

In particular, in the case of positive charge non-uniformities between the SZ and the IDZ, after aging of the photoreceptor with the same paper size for many thousands of prints, the non-uniformity will get "burned" into the photoreceptor. This will manifest in a number of ways. If the paper size is changed so that the previous interdocument zone becomes part of the image zone, then there will be a developed density difference causing banding between the previous IDZ and the SZ part of the image, the IDZ band being darker than the SZ. Also, if the IDZ is used for either voltage measurements or developed patches for electrostatic setup or process control, there will be a difference between the IDZ readings and the actual performance in the image area. In color systems this will cause color stability and color shift problems. A further problem occurs in the area of the photoreceptor corresponding to the edge of the paper. The transfer system is usually operated with a constant current device. The transition in impedance between the paper zone and IDZ causes a "ringing" or "edge leakage" in the residual charge at the edge of the paper resulting in a further banding defect known as "Paper Edge Ghosting" or "PEG". Finally if the paper width is less than the photoreceptor width, the non-paper inboard or outboard region of the photoreceptor will have similar positive residual charge differences to the IDZ differences and will result in darkened regions of subsequent images if the paper size is changed to cover parts of the previous inboard or outboard non-paper regions.

INCORPORATION BY REFERENCE

The following references, the disclosures of which are incorporated in their entireties by reference, are mentioned:

U.S. Pub. No. 2006/0263118 A1, published Nov. 23, 2006, entitled PHOTORECEPTOR CHARGING SYSTEMS AND METHODS, by Douglas A. Lundy, Michael J. Turan, Huoy-Jen Yuh, and Moritz Wagner, discloses a charging station with a second negative voltage that reduces the amount of positives charges trapped within layers of the inter-document zone of the photoreceptor.

BRIEF DESCRIPTION

Various sensors along a photoreceptor of an image forming device or printing system monitor image and interdocument voltages. Sensors can also monitor density control, such as density sensor (e.g., an ADC or ETAC sensor device, or full width array sensor) in order to measure the developed density differential directly between the two regions of an interdocument zone (IDZ) and a sheet zone (SZ). These measurements are fed back to a controller of the device or system for control of transfer current provided at a transfer station. Changing the transfer current during the IDZ can reduce the observed photoreceptor voltage difference between the IDZ and SZ with the effect of preventing the difference in image density.

In one embodiment, an image forming device has a photoreceptor, a charging device that generates electrical charge to the photoreceptor, an exposure station that patterns an exposure on the photoreceptor, and a development station to develop toner onto the photoreceptor. The device has a transfer station at a transfer location proximate to the photoreceptor that is configured to transfer toner from the photoreceptor to a printing medium with a transfer current. One or more sensors are operatively connected at an IDZ and the SZ, which obtain data from the IDZ and SZ at one or more locations along the photoreceptor. A controller controls charging and the exposure of the photoreceptor via the charging device, the exposure station and the transfer current to the transfer station. The controller is coupled to a feedback loop from the sensors that provide photoreceptor profile data to the controller. The controller is configured to modify the transfer current in response to data received from a first transfer current within the IDZ zone to a second transfer current based on the photoreceptor profile data received.

In another embodiment, a method for minimizing ghosting in an image forming device, comprising obtaining a first measurement at a first area of a photoreceptor in the image forming device, and obtaining a second measurement at a second area adjacent to the first area of the photoreceptor in the image forming device. The method further includes modifying a transfer current of a transfer device that transfers toner from the photoreceptor to a printing medium based on the first measurement and the second measurement so that a difference of the first measurement and the second measurement is maintained within a predetermined tolerance.

DETAILED DESCRIPTION

Methods and systems are disclosed that measure the profile of a photoreceptor at various locations and to modify transfer current and/or charge and/or exposure at the photoreceptor in feedback response. When a difference between the IDZ and SZ regions is detected among the locations, a control algorithm modifies transfer current as well as charge and/or exposure at the IDZ in order to minimize the effective difference therebetween. For example, a controller storing the control algorithm responds in a dynamic way to feedback data obtained from the photoreceptor profile sensed to control these effective differences, thereby mitigating ghost defects.

Figure 1:
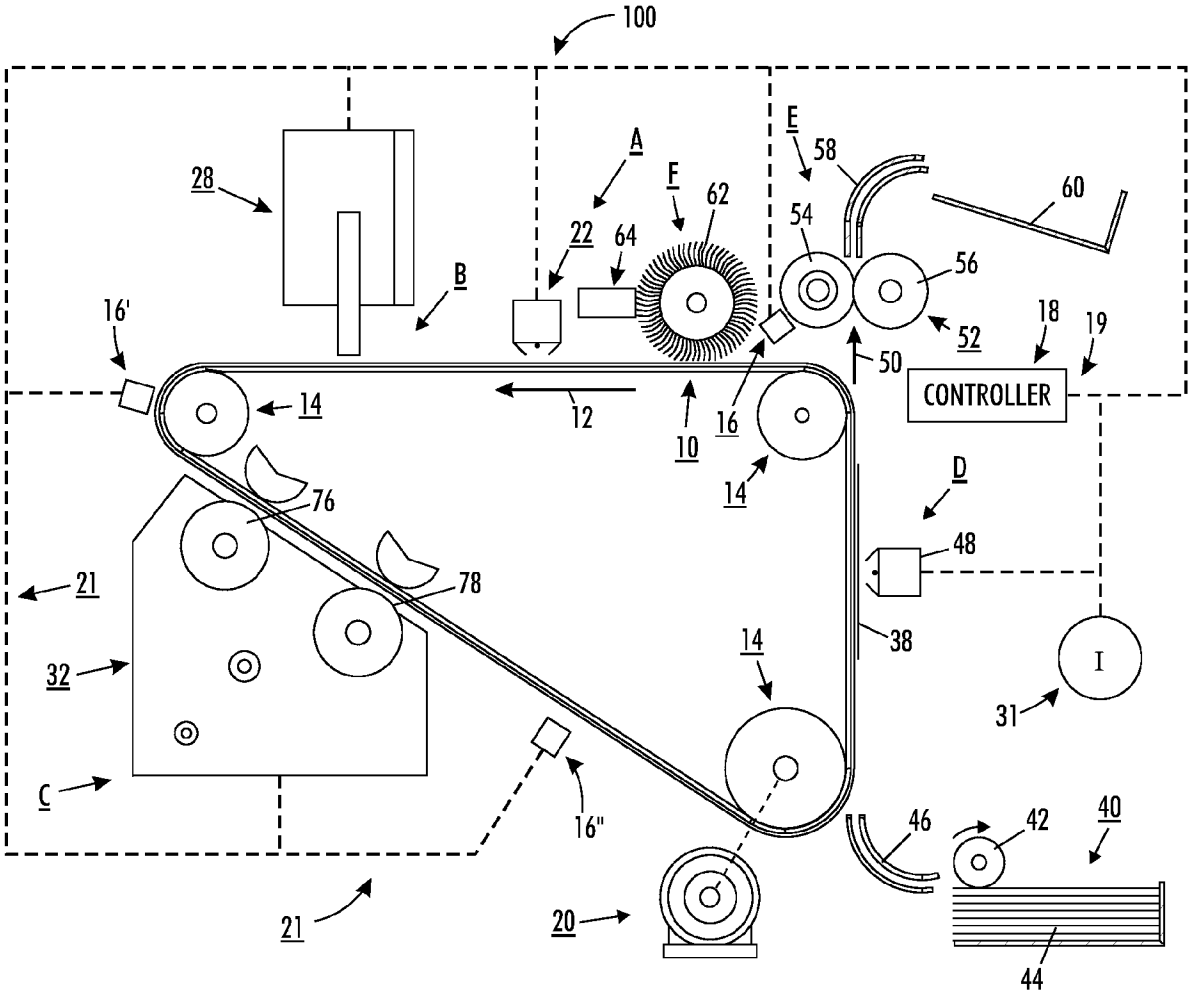
FIG. 1 is a schematic representation of an exemplary imaging system device.

FIG. 1 schematically depicts the various components of an illustrative electrophotographic printing/imaging system 100. A similar system is shown, for example, in U.S. Pat. No. 7,257,357, which is incorporated herein by reference. The various processing stations employed in the FIG. 1 printing machine are well known to one of ordinary skill in the art, and thus, are discussed herein briefly for purposes of exemplifying various embodiments of this disclosure.

The printing machine shown in FIG. 1 employs a photoconductor 10, such as a photoconductive belt or any suitable type of photoreceptor. The photoconductive belt illustrated, for example, moves in the direction of arrow 12 to advance successive portions of the photoconductive surface of the belt through the various stations. As shown, belt 10 is entrained about rollers 14, which are mounted to be freely rotatable and drive roller, which is rotated by a motor 20 with various rollers 14 to advance the belt in the direction of the arrow 12.

Sensors 16, 16', and 16" measure electrical parameters along the photoconductive belt at various locations and provide feedback to a controller 18. The sensors 16, 16', 16" obtain data pertaining to voltage levels, currents, and toner densities depending upon their location along the photoconductive belt 10 and function thereat. The sensors 16, 16', 16" may be located at any one point or at multiple location points along the photoreceptor 10 and are not limited by the example illustrated in FIG. 1 with regard to numbers or locations. For example, the number of sensors along the photoreceptor 10 can vary from one sensor 16, 16', or 16" to multiple sensors 16, 16', and/or 16" and other numbers of sensors depending upon the system. The sensors may also vary in type, such as an ESV, ADC or ETAC sensor to monitor toner densities, voltage or charge levels, transfer current, for example, among the IDZ and SZ at the photoreceptor 10 as will be further discussed below.

The controller 18 receives signals from various sensors in a feedback loop 21 at a feedback input 19 and is configured to store into memory data received. The data can then be compiled into a photoreceptor profile with respect to time in a memory (not shown) of the controller 18. Thus, in response to the signals received from the sensors 16, the controller 18 interprets the data as electrical measurements recorded over time and provides for adjusting electrical parameters at the photoreceptor belt 10 to prevent differentials occurring among IDZ and SZ regions of the photoreceptor and to further prevent ghost images that occur over time.

Initially, a portion of belt 10 passes through a charging station A. At charging station A, a corona generation device 22 charges the SZ portion of the photoconductive surface of belt 10 to a charge, for example, a relatively high, substantially uniform negative potential. Next, the charged portion of the photoconductive surface is advanced through an exposure station B. At exposure station B, after the exterior surface of photoconductive belt 10 is charged, the charged portion thereof advances to the exposure device. The exposure device includes a raster output scanner (ROS) 28, which illuminates the charged portion of the exterior surface of photoconductive belt 10 to record a first electrostatic latent image thereon. Alternatively, a light emitting diode (LED) may be used, for example.

The exposure device selectively illuminates the photoreceptor in areas requiring image development. As a result of light exposure in these areas, the photoreceptor is selectively discharged resulting in an electrostatic latent image corresponding to the desired print image. The belt 10 then advances the electrostatic latent image to a development station C.

At development station C, a development apparatus indicated generally by the reference numeral 32, transports toner particles to develop the electrostatic latent image recorded on the photoconductive surface. Toner particles are transferred from the development apparatus to the latent image on the belt, forming a toner powder image on the belt, which is advanced to transfer station D.

At transfer station D, a sheet of support material 38 is moved into contact with the toner powder image. Support material 38 is advanced to transfer station D by a sheet feeding apparatus 40, which could include a feed roll 42 that contacts the uppermost sheet of a stack of sheets 44. Feed roll 42 rotates to advance the uppermost sheet from stack 44 into chute 46. Chute 46 directs the advancing sheet of support material 38 into contact with the photoconductive surface of belt 10 in a timed sequence so that the toner powder image developed thereon contacts the advancing sheet of support material at transfer station D. Transfer station D includes a corona generating device 48, provided with a transfer current from current source 31, which sprays positive ions onto the back side of sheet 38. This attracts the toner powder image from the photoconductive surface to sheet 38. After transfer, the sheet continues to move in the direction of arrow 50 into a conveyor (not shown) which advances the sheet to fusing station E.

In one embodiment, the controller 18 dynamically alters the transfer current of a transfer station D, in addition to being operable to configure and re-configure the charge and exposure at the charge station A and/or the exposure station B respectfully in order to mitigate the effect of a change in performance at the IDZ and SZ zones.

Further along, fusing station E includes a fusing device 52, which permanently affixes the transferred powder image to sheet 38. Sheet 38 passes between a fuser roller 54 and a back-up roller 56 with the toner powder image contacting fuser roller 54, and thus, making the toner powder image permanently affixed to sheet 38. Chute 58 then advances the sheet to catch tray 60. Residual particles are removed from the photoconductive surface at cleaning station F, which can include a brush 62 for example. An erase station 64 is also included for an erase step that may be provided before or after the cleaning station F. The erase station 64 brings the photoreceptor voltage to a uniform low voltage level before the next charging cycle, effectively "erasing" residual negative charge therefrom.

As discussed above, the transfer current of transfer station D is modified. Modification of the transfer current depends upon the feedback that the controller 18 receives at its feedback input 19. Because ghosting involves more than one issue, adjustments made to the transfer current at the transfer station can be implemented as a preventative measure to vary the transfer current as a function of age.

In one embodiment, the sensors 16 are located at positions along the photoreceptor belt 10 for measuring the voltage levels after post-stripping between IDZ and SZ at the photoreceptor belt 10. The sensors 16" are located after the development station C and measure toner densities and/or voltage differentials, for example, between the IDZ and the SZ without paper during cycle-up or cycle down times. Sensors 16 monitor both the image voltage at the SZ and the IDZ voltages on the photoreceptor 10. In response to data pertaining to a photoreceptor voltage profile, the controller 18 modifies the current profile at the transfer station D by modifying the transfer current thereat. For example, an actuator (not shown) may be configured to modify the magnitude of the transfer current of the transfer station D in order to change the voltage profile recorded over time to a predetermined uniform or fixed offset profile. As differential measurements are collected from the SZ and IDZ of the photoreceptor 10, the controller 18 regulates current from the power source 31 to minimize the differences to a predetermined acceptable tolerance, for example, and thereby, reduce ghosting defects.

The transfer current at the transfer station D is therefore modified by the controller 18 in response to the data received at the feedback input 19 pertaining to density variations of toner and voltage level differences occurring. Voltage level differences are measured and used, for example, to reference charge at the photoreceptor, which is in proportion to the voltages measured. In particular, a corotron or the like transfer device at transfer station D produces a positive charge with a positive corona on the back of a paper sheet to transfer an image. In response to feedback retrieved by the controller 18, the power supply 31 is used to control the amount of current provided, and thus, the amount of positive current that is used to shower on the back of the paper. An advantage of modifying the photoreceptor profile at the transfer current of the transfer station D is to prevent long term aging of the photoreceptor from being observed as profoundly with ghosting defects and operate to keep the photoreceptor profile substantially uniform or at a fixed IDZ vs SZ offset by dynamically adjusting the transfer current used to operate transfer devices in response to feedback. This works to minimize density variations and process direction ghosting between IDZ and SZ regions that can occur when the SZ is changed in paper size and the boundaries between the SZ and IDZ are altered.

Further, the controller 18 is operable to modify the charge provided at the charging station A and/or the exposure provided at the exposure station B. For example, the controller 18 is operable to modify charge and exposure voltage levels when feedback from the sensors indicates a differential between IDZ and SZ regions. For example, the feedback 21 is provided to the feedback input 19 as a differential signal between IDZ and SZ of the photoreceptor. In response, the output of the charging station A and/or the exposure station B can be modified in conjunction or independently with modification of the transfer current operating the transfer station D. This added measure of operation has an advantage of remedying an effective delta (e.g., toner density or other parameter) between the regions observed after the photoreceptor develops a signature or ghosting image defect, which has been burned or made permanent into the photoreceptor over time, for example.

Figure 2:
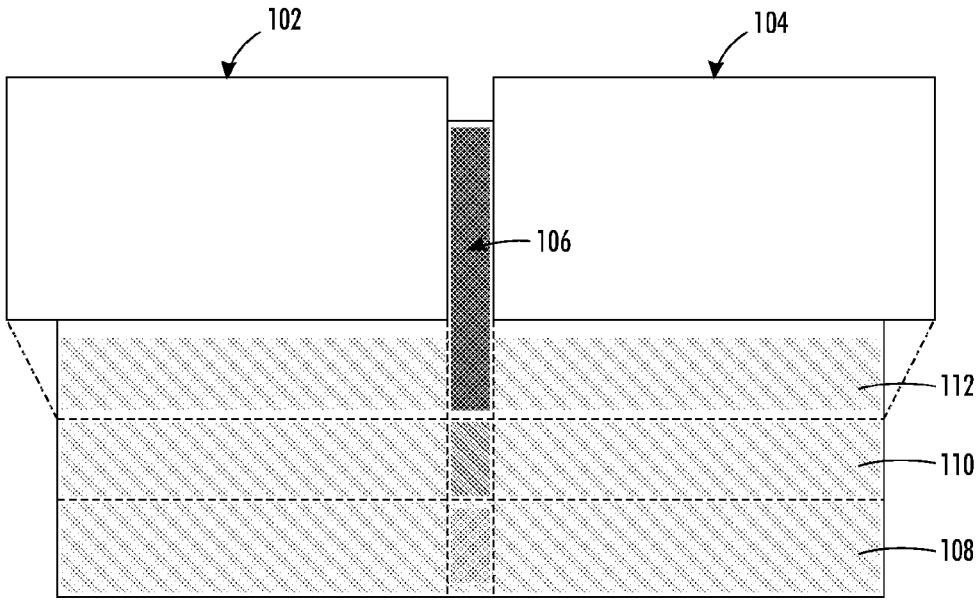
FIG. 2 is an illustration of paper edge ghost occurring on a printing medium.

FIG. 2 depicts two sheets of image receiving medium 102, 104 that were continually run through an image forming device or photoreceptor system for printing and/or imaging. As a result of processing the same paper size through the imaging system photoreceptor, a signal gets burned into it, which effectively causes a difference in toner densities and voltage level. In addition, however, over time and processing of many sheets, boundaries of the IDZ fall into the SZ regions. The two sheets 102, 104 are spaced apart from each other to create the IDZ 106 therebetween. After one thousand exposures, for example, a sheet of image receiving medium 108 having a size equal to image receiving medium 102 and 104 combined and including the IDZ 106 has been processed through the image forming apparatus with the photoreceptor 10. The portion of the image receiving medium 108 corresponding to the IDZ 106 delineates paper edge ghost resulting from one thousand exposures. Image receiving medium 110 and 112 have sizes that correspond to image receiving medium 108. The portions of image receiving medium 110 and 112 corresponding to space 106 show paper edge ghost resulting from three thousand exposures and six thousand exposures respectively, where the density of toner thereon varies according to long term repeated patterns.

Figure 3:
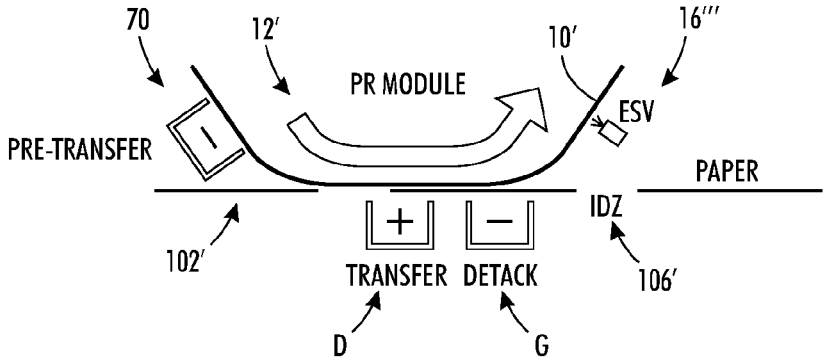
FIG. 3 is schematic representation of a photoreceptor module and sensor for measuring voltage differences at different portions of the module.

Referring now to FIG. 3, illustrates an electrostatic voltage (ESV) sensor 16'''. The ESV sensor 16''' is a post-stripping ESV sensor, located after a detack station G that is subsequent to the transfer station D where the image is transferred to a sheet 102' by a positive charge thereat. At the detack station G substrate is stripped with a smaller negative charge. A photoreceptor module 10' is shown moving in direction 12' with the ESV sensor 16''' located past the detack station G. In order to monitor variations of the photoreceptor profile between the SZ of sheet 102' and an IDZ zone 106', non-uniformity measurements are taken by the post-stripping ESV sensor 16''', which monitors both the image and interdocument voltages on the photoreceptor and generates a differential signal sensed.

Figure 4:
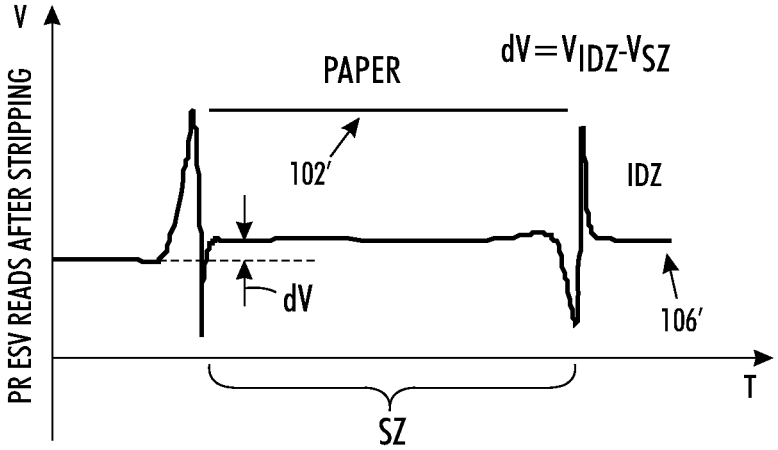
FIG. 4 is a schematic representation of charges referenced at different portions of a photoreceptor.

FIG. 4 illustrates in a photoreceptor profile as collected from the data of the ESV sensor 16''' of FIG. 3 and compiled by the controller 18. The profile illustrated is an IDZ 106' compared to an SZ 102' voltage generated with respect to time after stripping at a transfer station and/or a detack unit, for example. The difference in voltage level (dV), as illustrated, demonstrates a differential that results between the zones, thereby inducing ghost effects at the photoreceptor. The sensors detect differentials and signal the controller in a feedback mechanism. Differential signals are retrieved by the controller, which creates a profile of the parameters related to the photoreceptor, such as a photoreceptor voltage profile over time, as depicted in FIG. 4, or other parameter.

Figure 5:
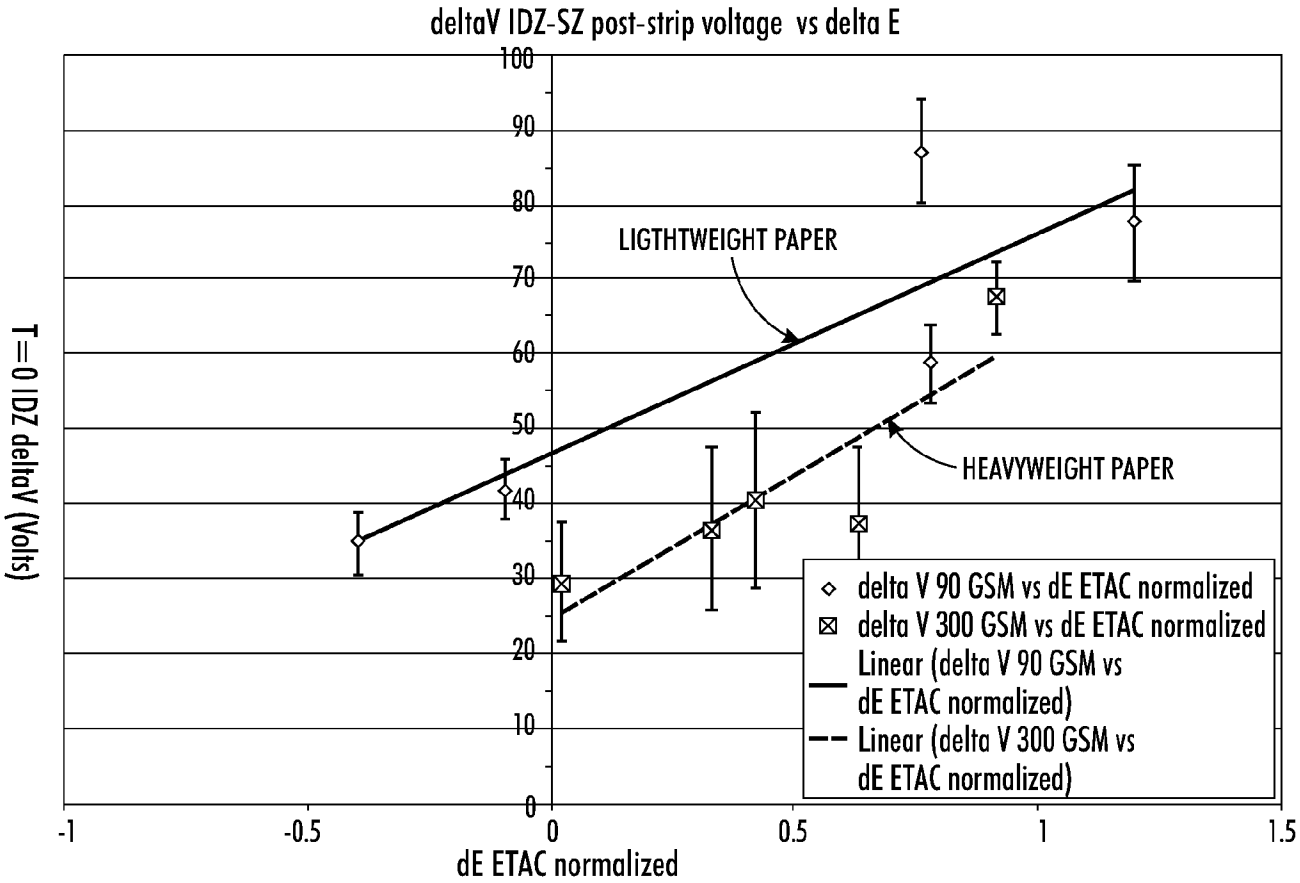
FIG. 5 is a schematic representation of the correlation of the 6000 print aged photoreceptor developed density difference (dE ETAC normalized) with the time=0 photoreceptor voltage difference measured post paper strip.

Referring to FIG. 5, illustrates a correlation of T=0 post-stripping differential photoreceptor voltages to aged photoreceptor differential image density after aging with one media size when imaging in both SZ and IDZ. The post-stripping ESV, for example, measures photoreceptor voltage non-uniformity at T=0 before the non-uniformity has been burned into the photoreceptor. Preliminary correlations of this measurement are illustrated here with measurements of ghosting non-uniformity after 6000 prints of aging. A controller 18 monitors the post-stripping signal and varies the IDZ current to maintain the post-stripping IDZ versus SZ voltage difference which correlates with zero density difference between the aged IDZ and SZ.

In one embodiment, a pre-development ESV (i.e., before the development station C) also monitors the differential image region versus interdocument photo discharge voltage during cycle-up or cycle out, which induces ghosting from the changing size of the paper among different print jobs, such as when a new SZ consists of a mix of former IDZs and SZs. In another embodiment, a full width-array density sensor can be used to monitor the differential image versus interdocument zone developed toner density without paper during cycle-up or cycle-down. Alternatively, an ADC or ETAC sensor could be used to monitor similar differential densities during cycle-up and cycle-down processes. However these differential signals may not manifest until a few thousand prints have been run and the photoreceptor has begun to be "burned in." To prevent such a defect, the transfer current is modified from the beginning at T=0.

Further, these methods may be combined to vary the IDZ transfer current to modify the post-stripping signal retrieved by the controller in feedback to the desired level and fine tune the IDZ current as the system ages using a predevelopment voltage signal or density sensor to further minimize any SZ versus IDZ density differential. This would make use of multiple locations along the photoreceptor sensed for feedback control to the controller.

Figure 6:
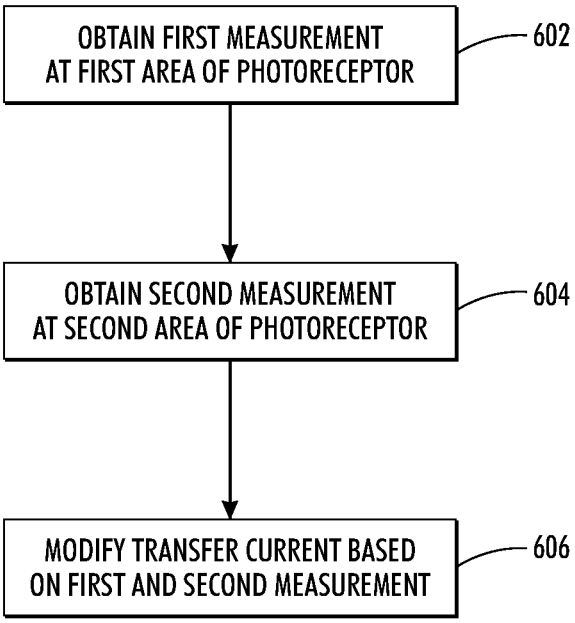
FIG. 6 is a flowchart detailing a general process for minimizing ghost defect in an imaging device.

An example methodology 600 for minimizing ghosting in an image forming device is illustrated in FIG. 6. While the method 600 is illustrated and described below as a series of acts or events, it will be appreciated that the illustrated ordering of such acts or events are not to be interpreted in a limiting sense. For example, some acts may occur in different orders and/or concurrently with other acts or events apart from those illustrated and/or described herein. In addition, not all illustrated acts may be required to implement one or more aspects or embodiments of the description herein. Further, one or more of the acts depicted herein may be carried out in one or more separate acts and/or phases.

At 602, a first measurement is obtained at a first area of a photoreceptor. The measurement includes parameters such as toner density thereon, voltage level, exposure amount, and the like. The first area includes an IDZ or SZ region at the photoreceptor 10.

At 604, a second measurement is obtained at a second area adjacent to the first area. The second area includes one of the IDZ or SZ region different from the first area, for example.

At 606, a transfer current is modified based on the first measurement and the second measurement so that a difference therebetween is maintained within a predetermined tolerance. For example, the tolerance may be substantially equal to zero in order to prevent the differential profile from being sensed and mitigate the ghost defect from showing up.

In one embodiment, the second area comprises the SZ region of the photoreceptor. As this region is varied from different sized SZ regions overlapping, for example, the IDZ of the photoreceptor, a differential profile in voltage level or toner density is sensed. This, in turn, causes a controller of the printing device to modify the transfer current at a transfer device.

In another embodiment, the first measurement and the second measurement are sensed at various locations along the photoreceptor. These measurements are all fed back to a controller that modifies currents, voltage and/or exposure to mitigate differentials occurring.

The exemplary method may be implemented on one or more general purpose computers, special purpose computer (s), a programmed microprocessor or microcontroller and peripheral integrated circuit elements, an ASIC or other integrated circuit, a digital signal processor, a hardwired electronic or logic circuit such as a discrete element circuit, a programmable logic device such as a PLD, PLA, FPGA, or PAL, or the like. In general, any device, capable of implementing a finite state machine that is, in turn, capable of implementing the flowchart shown in FIG. 6.

It will be appreciated that variants of the above-disclosed and other features and functions, or alternatives thereof, may be combined into many other different systems or applications. Various presently unforeseen or unanticipated alternatives, modifications, variations or improvements therein may be subsequently made by those skilled in the art which are also intended to be encompassed by the following claims.

What is claimed is:

1. An image forming device, comprising:

a photoreceptor;

a charging station configured to electrically charge the photoreceptor;

an exposure station configured to generate a latent image on the photoreceptor;

a development station configured to transfer toner to the photoreceptor;

a transfer station configured to transfer a toner image from the photoreceptor to a printing medium with a transfer current;

one or more ESV (electrostatic volt) sensors operatively associated with an IDZ (interdocument zone) associated with the photoreceptor and a SZ (sheet zone) associated with the photoreceptor, the ESV sensors configured to measure an IDZ voltage at more than one location along the photoreceptor and measure an SZ voltage at more than one location along the photoreceptor;

a controller configured to control one or more of the charging station, the exposure station and the transfer station, the controller operatively connected to the one or more ESV sensors and the controller configured to generate a first transfer current substantially within the SZ and a second transfer current within the IDZ, the second transfer current generated by modifying the first transfer current to substantially equalize the IDZ voltage and the SZ voltage measured at more than one location along the photoreceptor.

2. The device of claim 1, wherein the controller is configured to reduce a difference in trapped charge between the IDZ and SZ of the photoreceptor based on a photoreceptor voltage profile associated with the measured SZ voltage and measured IDZ voltage.

3. The device of claim 1, wherein the controller is configured to generate a photoreceptor voltage profile with respect to time, and to signal one or more of the transfer station, the exposure station and the charging station to vary the transfer current and/or charge respectively generated at the interdocument zone to reduce voltage differences generated in the profile.

4. The device of claim 1, wherein the interdocument zone is located between adjacent sheet zones of the photoreceptor and varies in size depending upon a size of the sheet zone.

5. A method for minimizing one or moth of ghosting and process control instability in an image forming device, comprising:

obtaining a first voltage measurement of an IDZ (interdocument zone) associated with a photoreceptor operatively associated with the image forming device;

obtaining a second voltage measurement of a SZ (sheet zone) adjacent to the IDZ of the photoreceptor in the image forming device;

modifying a transfer current of a transfer device configured to transfer toner from the photoreceptor to a printing medium based on the first voltage measurement and the second voltage measurement so that a difference of the first voltage measurement and the second voltage measurement is maintained within a predetermined tolerance, wherein the first voltage measurement and the second voltage measurement are obtained at more than one location along the photoreceptor;

the transfer current is modified in response to the first voltage measurement and the second voltage measurement obtained at more than one location along the photoreceptor; and the difference is reduced between the first voltage measurement and the second voltage measurement at each location.

6. The method of claim 5, comprising:

varying dimensions of the SZ according to varying dimensions of the printing medium.

7. The method of claim 6, comprising:

reducing a difference in trapped charge between the inter-document zone and the sheet zone of the photoreceptor by modifying a charge provided to the photoreceptor so that a difference in voltage measured at each zone is reduced.

* * * * *